US008358019B2

(12) United States Patent
Lemus

(10) Patent No.: US 8,358,019 B2
(45) Date of Patent: Jan. 22, 2013

(54) ELECTRICAL GENERATOR AND METHOD OF GENERATING ELECTRICITY

(75) Inventor: Manuel Lemus, Clovis, CA (US)

(73) Assignee: Kajavic Industries, Inc., Clovis, CA (US)

( * ) Notice: Subject to any disclaimer, the term of this patent is extended or adjusted under 35 U.S.C. 154(b) by 751 days.

(21) Appl. No.: 12/577,163

(22) Filed: Oct. 10, 2009

(65) Prior Publication Data

US 2011/0084498 A1 Apr. 14, 2011

(51) Int. Cl.
*F02B 63/04* (2006.01)
*H02K 7/18* (2006.01)

(52) U.S. Cl. ..... 290/1 A

(58) Field of Classification Search ..... 290/1 A, 290/4 A, 4 C, 4 D; 60/398, 698; 417/411; 74/DIG. 9
See application file for complete search history.

(56) References Cited

U.S. PATENT DOCUMENTS

| | | | | | |
|---|---|---|---|---|---|
| 2,230,526 | A * | 2/1941 | Claytor | 290/44 |
| 3,512,072 | A * | 5/1970 | Karazija et al. | 320/127 |
| 4,010,378 | A * | 3/1977 | Tharpe et al. | 290/2 |
| 4,124,978 | A * | 11/1978 | Wagner | 60/410 |
| 4,206,608 | A * | 6/1980 | Bell | 60/698 |
| 4,229,661 | A * | 10/1980 | Mead et al. | 290/44 |
| 4,409,490 | A * | 10/1983 | Caputo | 290/4 D |
| 4,525,631 | A * | 6/1985 | Allison | 290/4 R |
| 4,759,560 | A * | 7/1988 | Virgulti | 280/47.26 |
| 4,827,152 | A * | 5/1989 | Farkas | 307/68 |
| 5,097,194 | A * | 3/1992 | Walton et al. | 320/128 |
| 5,296,799 | A * | 3/1994 | Davis | 322/35 |
| 5,373,198 | A * | 12/1994 | Lopez Jimenez | 307/68 |
| 5,606,233 | A * | 2/1997 | Davis | 318/142 |
| 6,856,033 | B2 * | 2/2005 | Patel | 290/40 C |
| 7,388,299 | B2 * | 6/2008 | Blackman | 290/4 R |
| 7,642,487 | B2 * | 1/2010 | Silvestro | 219/133 |
| 7,898,098 | B2 * | 3/2011 | Wang | 290/31 |
| 7,939,952 | B2 * | 5/2011 | Borghi | 290/1 A |
| 8,080,888 | B1 * | 12/2011 | Daley | 290/43 |
| 2002/0144504 | A1 * | 10/2002 | Merswolke et al. | 60/398 |
| 2005/0173925 | A1 * | 8/2005 | Farkas | 290/1 A |
| 2008/0023965 | A1 * | 1/2008 | Cagliari et al. | 290/1 B |
| 2008/0083222 | A1 * | 4/2008 | Hubert | 60/698 |
| 2009/0273190 | A1 * | 11/2009 | Wang | 290/1 R |
| 2010/0072760 | A1 * | 3/2010 | Anderson et al. | 290/1 R |
| 2011/0156402 | A1 * | 6/2011 | Khymych | 290/55 |
| 2011/0187123 | A1 * | 8/2011 | Hamm et al. | 290/1 A |
| 2011/0308382 | A1 * | 12/2011 | Huff et al. | 91/459 |
| 2012/0146441 | A1 * | 6/2012 | Galvan | 310/113 |

* cited by examiner

*Primary Examiner* — Julio C. Gonzalez R.
(74) *Attorney, Agent, or Firm* — Richard A. Ryan

(57) ABSTRACT

An environmentally friendly and efficient electrical generator and system for and method of generating electricity comprises a source of power having one or more batteries, an electric motor powered by the batteries, a hydraulic pump operated by the motor to pressurize a fluid, a first hydraulic motor powered by the pump, a rotating shaft attached to the first hydraulic motor, an air pressurized hydraulic system and an output alternator connected to the shaft to generate electricity. In the preferred embodiment, the air pressurized hydraulic system comprises a compressor operatively connected to the shaft to pressurize air, an air amplifying mechanism to increase the flow rate of the pressurized air, a pressurizing tank to increase the pressure of the pressurized air, a hydraulic power unit to pressurize fluid with the pressurized air, a second hydraulic motor powered by the pressurized fluid and a recharging alternator to recharge the batteries.

17 Claims, 9 Drawing Sheets

ELECTRICAL GENERATOR AND METHOD OF GENERATING ELECTRICITY

CROSS-REFERENCE TO RELATED APPLICATIONS

None.

STATEMENT REGARDING FEDERALLY SPONSORED RESEARCH

Not Applicable.

BACKGROUND OF THE INVENTION

A. Field of the Invention

The field of the present invention relates generally to apparatuses and methods for generating electricity. More particularly, the present invention relates to such apparatuses and systems which utilize batteries, hydraulic motors, inverters and pressurized air to generate electricity, specially for use at or near where the electricity is produced. Even more particularly, the present invention relates to such apparatuses and systems which utilize a specially configured air tank to pressurize air to power a hydraulic motor to generate electricity.

B. Background

Apparatuses and systems for converting a source of energy to useful power for generating electricity have been generally available for many years. A common arrangement for generating electricity is a large power plant that delivers the produced electricity to the end user over long distance transmission lines. As is commonly known, such power plants are very complicated and very expensive, requiring large capital investment in the power plant and the transmission lines. Presently, most large power plants rely on traditional sources of energy, such as oil, natural gas, coal, nuclear, stored water and the like to produce electricity. There is a strong effort to provide alternative apparatuses and systems to power machines, particularly generators for producing electricity, that utilize energy sources which have less environmental impact, generally by being more readily available, cleaner and, preferably, renewable. For instance, many people and organizations have been attempting to utilize wind, solar, tidal and geothermal resources as a source of power to operate generators for the production of electricity. Although such sources of energy have been well known and, to some extent, in use for many years, it has only been relatively recent that substantially increased efforts have been directed towards improving the efficiency of these energy systems so they may be capable of generating more electricity. Currently, such alternative energy systems are a relatively small percentage of the total electricity production.

In general, the increased push for apparatuses and systems that generate electricity without utilizing conventional, non-renewable and polluting energy sources, particularly hydrocarbon fuels, is a direct result of the known limited supply of these energy sources and the negative impact the use of such sources has had on the environment. Unfortunately, at the same time that the supplies of conventional sources of energy have become scarcer and the impacts of such sources have become more well known, the demand for electricity has substantially increased. The increase in demand is driven by a number of factors, including but not limited to the expansion in the number of devices that are powered by electricity, such as computers, air conditioning, audio systems, kitchen appliances and a vast number of other devices, and the rapid expansion in the number of people who have the desire and access to such devices. In fact, as an example, many people desire to make telephones, computers and other electronic devices more widely available to others and to replace dirty burning machines, including hydrocarbon fuel-based vehicles, with machines powered by electricity. While such goals are generally laudable, an unintended consequence of increasing the availability of electronic devices and producing electricity-based vehicles is a substantial increase in the demand for electricity. The increase in demand for electricity will have to be supplied by those apparatuses and systems that are available, which, at least presently, primarily rely on hydrocarbon-based fuels to provide the necessary power. As the need for electricity increases, the supply of fossil fuels to produce electricity is further reduced, the environmental impacts of these fuels worsen and the cost of using electricity increases. Even though the cost of electricity is anticipated to rise and there may be availability problems, most experts expect that the demand for electricity will substantially increase during the foreseeable future. In fact, consumers generally expect that electricity will be available to them when they need it, whether to operate an appliance, energize a light source or drive a machine.

Although electricity is generally produced and provided to the public by large power plants, there is often a need for localized production of electricity for use at or very near the location where it is produced. One advantage of such electricity production is that it eliminates the requirement to transmit the electrical power over long distances, thereby substantially eliminating the cost to build such long distance transmission lines, the cost of acquiring the right-of-way for the land and the use of the land to support those lines. For areas that are somewhat off of the normal power grid, the cost of building the necessary transmission lines and the cost to maintain those lines can be significant. To be effective, however, a localized electricity producing apparatus and system must be of sufficient size to supply the needed amount of electricity and must be able to reliably supply that electricity. Presently, relatively small generators and systems that for localized production of electricity are generally not available and are not well accepted by those who could otherwise benefit from such apparatuses and systems.

Localized production of electricity is somewhat epitomized by the use of portable generators, such as the type commonly utilized to power construction sites and other locations where electrical power may not otherwise be available or connected and to provide emergency power in case of loss of the traditional electrical power supply. The typical portable generator utilizes gasoline, diesel, propane or other hydrocarbon-based fuel, in part due to the ease of availability for such fuels, to operate the machinery that produces the electricity. Unfortunately, in addition to their reliance on non-renewable fossil fuels, these generators are well known for being loud and for producing smoke or other air-borne waste, thereby contributing to localized noise and air pollution.

What is needed, therefore, is an improved apparatus and system for producing power to generate electricity. A preferred electrical power generation apparatus and system is one which effectively and efficiently produces the desired amount of electricity and is particularly suitable for localized use of such electricity. Preferably, a new electrical power generating apparatus and system should produce electricity without using non-renewable sources of energy, such as fossil fuels or the like, should produce relatively little or no air pollution and be relatively quiet. A preferred electrical power generating apparatus and system is one which is relatively simple to use and reliable.

SUMMARY OF THE INVENTION

The electrical generator and method of generating electricity of the present invention solves the problems and provides the benefits identified above. That is to say, the present invention discloses a new and improved electrical generator and method of generating electricity that effectively and efficiently produces the desired amount of electricity. In the preferred embodiments of the present invention, the electrical generator produces electricity without reliance on fossil or other non-renewable sources of energy. As such, the new electrical generator and method of generating electricity produces electricity with relatively little or no output of pollutants. The new apparatus and method of the present invention is particularly useful for localized production of electricity, either for use as a fixed electrical generating facility or as a portable electrical generator.

In one embodiment of the present invention, the electrical generator comprises a source of power having one or more batteries, an electric motor powered by one of the batteries, a battery controller configured to select one of the batteries to power the electric motor and the others to be recharged, a hydraulic pump operatively connected to the electric motor to pressurize a fluid, a first hydraulic motor powered by the pressurized fluid to rotate a shaft connected to the first hydraulic motor, an output alternator connected to the shaft to generate the output electricity of the electrical generator, an air pressurized hydraulic system to pressurize air and use the pressurized air to pressurize fluid and a recharging alternator operatively connected to the air pressurized hydraulic system to recharge the batteries not supplying power to the electric motor. In a preferred embodiment, the air pressurized hydraulic system comprises a compressor operatively connected to the shaft to pressurize air and direct the pressurized air through a pressure tube, an air amplifying means associated with the pressure tube to increase the flow rate of the pressurized air, a pressurizing tank connected to the pressure tube for receiving the pressurized air and increasing the pressure thereof and a hydraulic power unit pneumatically connected to the pressurizing tank for receiving pressurized air therefrom and utilizing the pressurized air to pressurize hydraulic fluid for use by a second hydraulic motor, which powers the charging alternator. In the preferred embodiment, the pressurizing tank comprises an outer cylinder and an inner rod assembly disposed in the outer cylinder. The outer cylinder has an air inlet at a first end and an air outlet at a second end. The inner rod assembly has an inner rod with an open first end at the air inlet and a closed second end towards the second end of the outer cylinder. The inner rod assembly is configured to input pressurized air into the interior of the outer cylinder from the pressure tube and output pressurized air, at a higher pressure, through the air outlet of the outer cylinder to the hydraulic power unit. The inner rod of the inner rod assembly has a first backflow preventer towards the first end of the inner rod, a second backflow preventer towards the second end of the inner rod, a plurality of discharge apertures in the inner rod between the first backflow preventer and the second backflow preventer and a housing interconnecting the first backflow preventer and the second backflow preventer that encloses the discharge apertures to direct pressurized air from the inner rod to outside of the inner rod assembly and into the outer cylinder through the first and second backflow preventers. Preferably, the inner rod assembly further comprises an inner baffle and an outer baffle towards each of the first and second ends of the inner rod, with one inner baffle and one outer baffle disposed between the discharge apertures and the first backflow preventer and one inner baffle and one outer baffle disposed between the discharge apertures and the second backflow preventer. In the preferred embodiment, each of the first backflow preventer and the second backflow preventer has a conically shaped body with a plurality of apertures thereon and each of the inner baffles has a plurality of inner apertures and each of the outer baffles has a plurality of outer apertures. Preferably, the inner and outer apertures are offset aligned and the inner apertures are a larger size than the outer apertures to provide improved baffling.

Accordingly, the primary objective of the present invention is to provide an electrical generator and method of generating electricity that provides the benefits described above and solves the problems associated with presently available apparatuses and systems for producing electricity.

More specifically, it is a primary objective of the present invention to provide an electrical generator and method of generating electricity that efficiently produces electricity without reliance on fossil fuels or other non-renewable sources of energy.

Even more specifically, the primary objective of the present invention is to provide an electrical generator and method of generating electricity that produces electricity with little or no output of air pollutants to the atmosphere.

It is also an object of the present invention to provide an electrical generator and method of generating electricity that is particularly beneficial for localized production of electricity, including as a fixed but remote power facility and as a portable electrical generator.

Another object of the present invention is to provide an electrical generator and method of generating electricity that utilizes a specially configured air pressurizing tank for increasing the pressure and flow rate of air so that the air may be more beneficially utilized to power a hydraulic motor which operates a generator to generate electricity.

The above and other objectives of the present invention are explained in greater detail by reference to the attached figures and description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of a preferred embodiment and represent one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are directed generally to use of the present invention as a portable generator, those skilled in the art will readily understand that this is merely for purposes of simplifying the present disclosure and that the present invention is not so limited.

Figure 1:
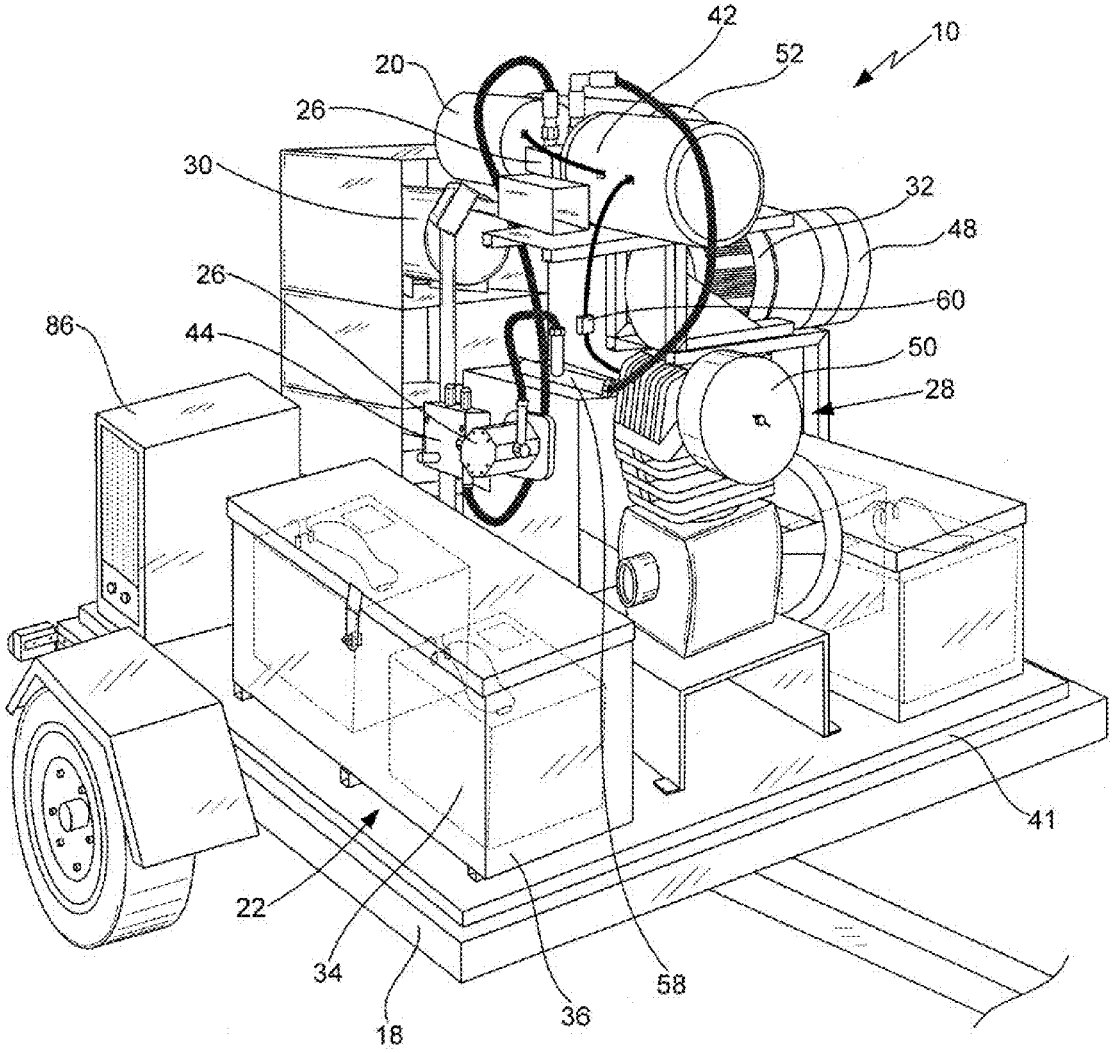
FIG. 1 is a front perspective view of the left side of an electrical generator configured according to a preferred embodiment of the present invention shown mounted on a trailer for use as a portable electrical generator.
Figure 2:
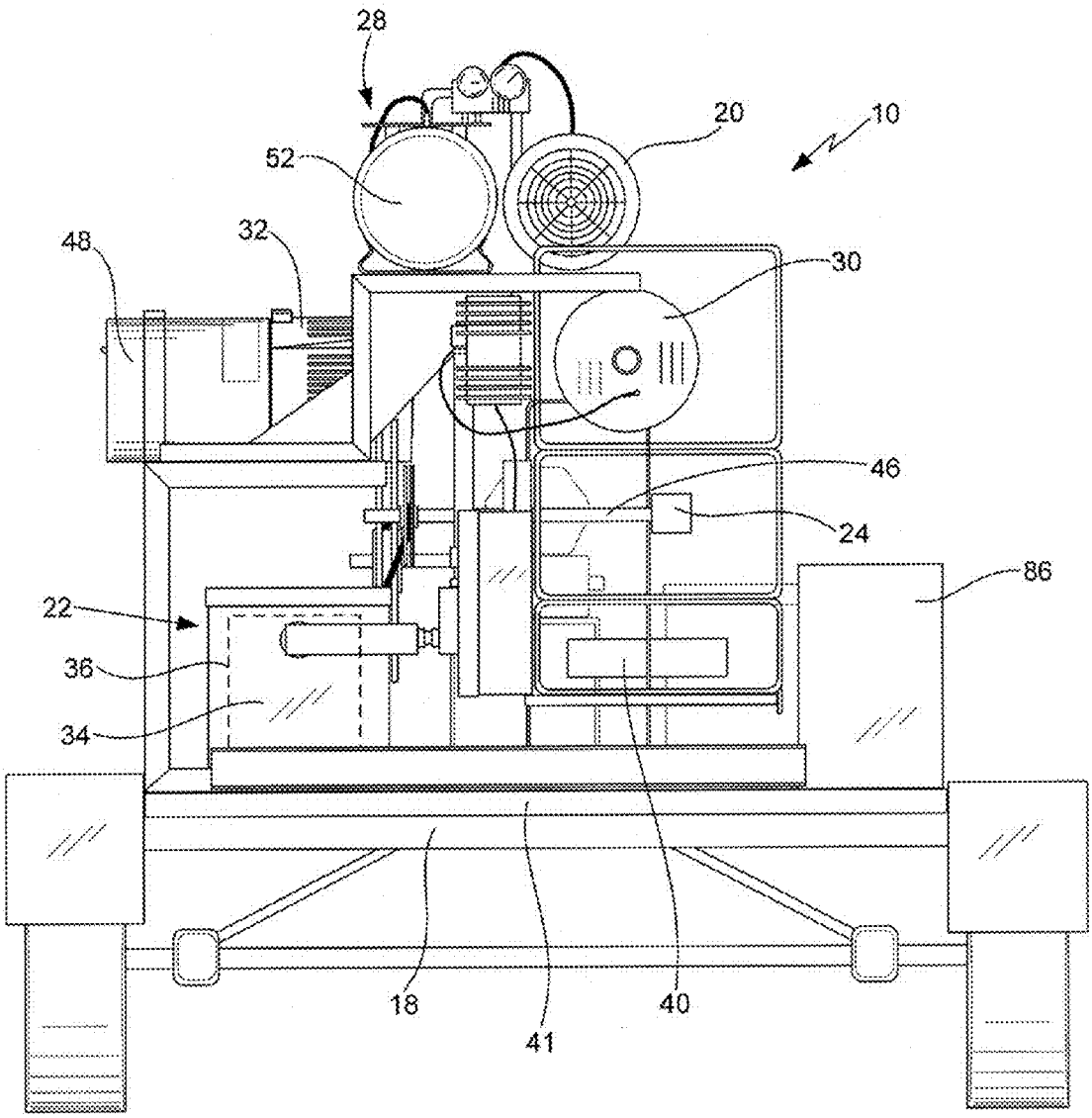
FIG. 2 is a rear view of the electrical generator of FIG. 1.
Figure 3:
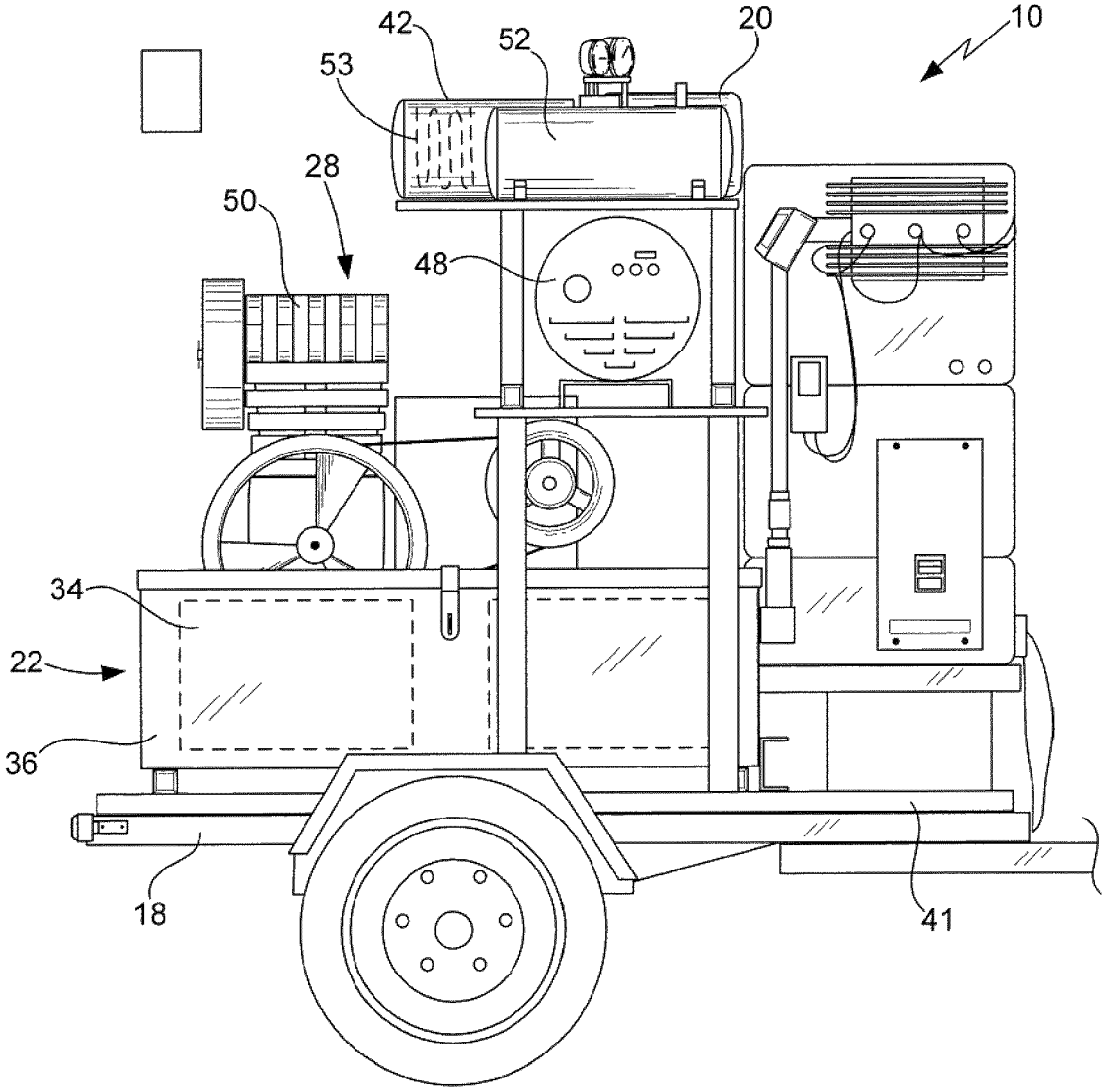
FIG. 3 is a right side view of the electrical generator of FIG. 1.

An electrical generator that is manufactured out of the materials and configured pursuant to a preferred embodiment of the present invention is shown generally as 10 in FIGS. 1 and 2. Electrical generator 10 is utilized as with the electrical generating system 12 and as a component of the electrical generating method 14 of the present invention to generate output electricity, shown as 16 in FIGS. 4 and 5, that can be put to beneficial use to operate a wide variety of electrically powered devices. In FIGS. 1 through 3, the electrical generator 10 is shown in use as a portable generator mounted on a small, easily transportable trailer 18. As set forth above, those skilled in the art will readily understand that the present invention is not so limited and that it may be mounted to the back of a truck bed, a large enclosed trailer or other portable devices or vehicles and that it may be mounted to the floor of a building or placed on or in its own structure that is fixed in place. As with other generators, the electrical generator 10 of the present invention may be utilized as either the primary or as a back-up source of electrical power. The selection of the components and sizes of the components for electrical generator 10 can be varied, as selected by the manufacturer and/or end user, to provide the desired amount of output electricity 16.

Figure 4:
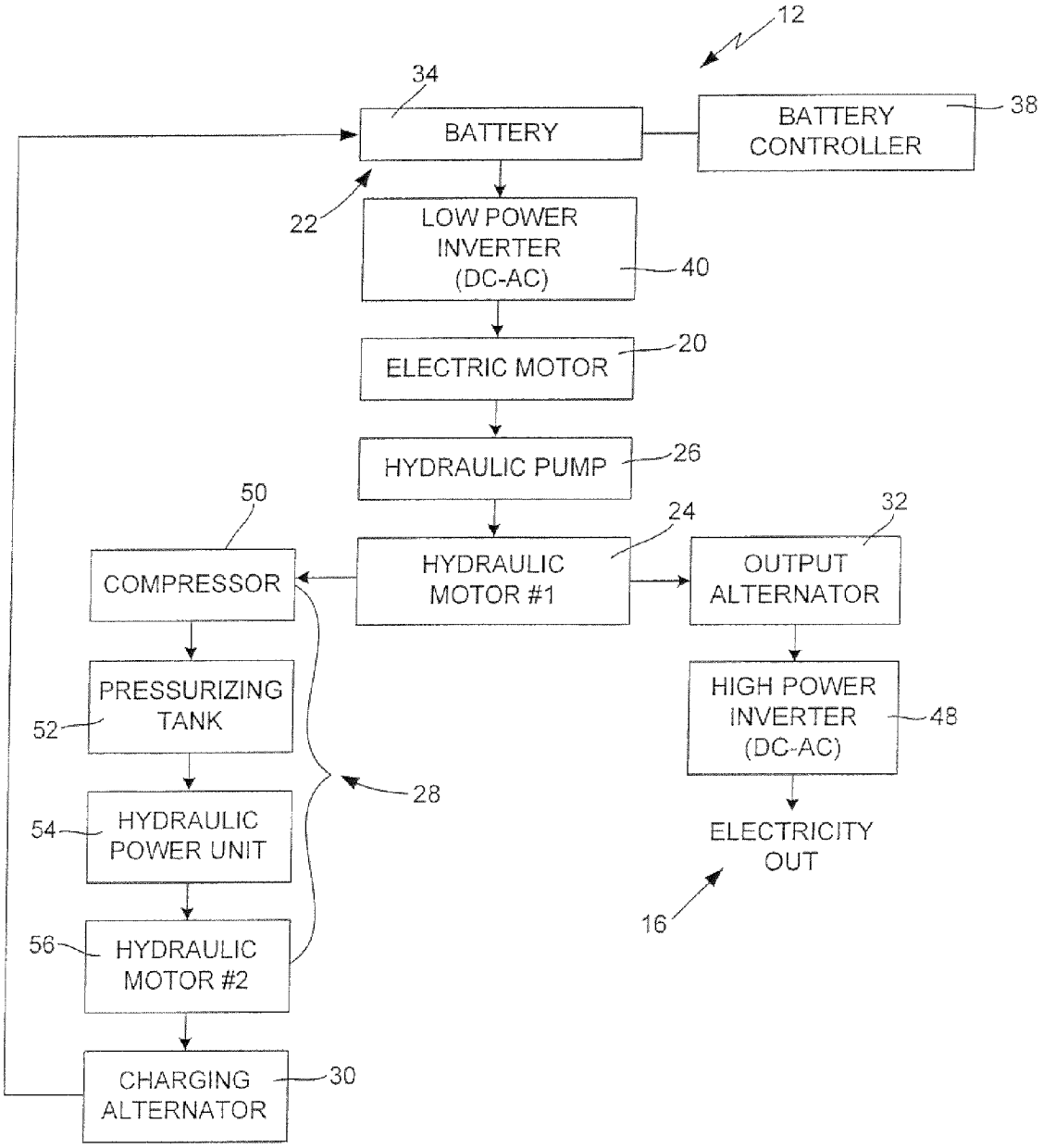
FIG. 4 is a flow chart showing the generating system of the present invention utilizing the electrical generator of FIG. 1.
Figure 5:
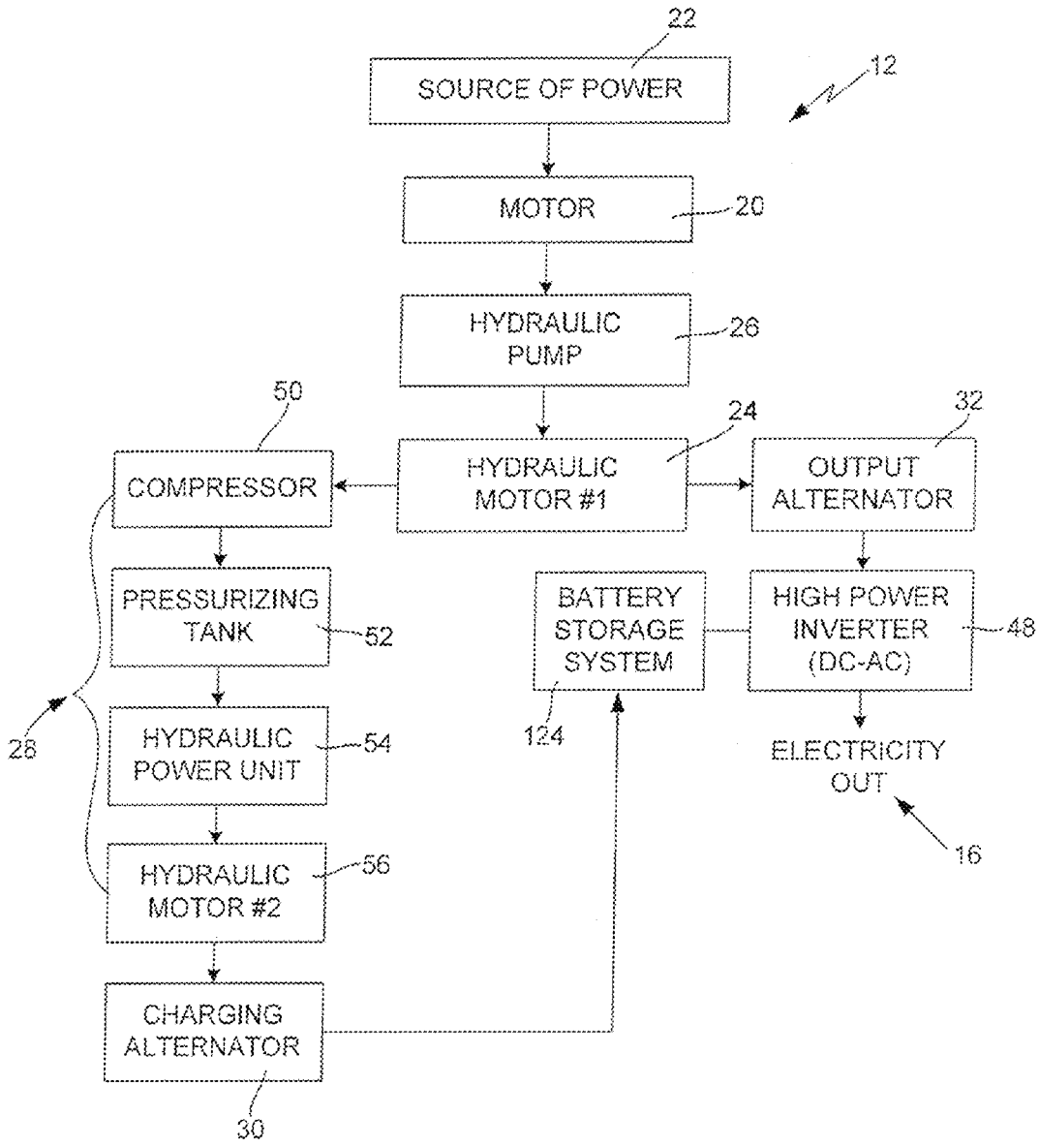
FIG. 5 is a flow chart showing an alternative embodiment of the generating system of the present invention.

As best set forth in FIGS. 1 through 3 and the flow charts of FIGS. 4 and 5, electrical generator 10 of the preferred embodiment generally comprises a motor 20 powered by a source of power 22, a first hydraulic motor 24 powered by pressurized hydraulic fluid from hydraulic pump 26 that is powered by the electric motor 20, an air pressurized hydraulic system 28 operatively connected to and powered by the hydraulic motor 24, a charging alternator 30 powered by the air pressurized hydraulic system 28 and a output alternator 32 that produces the electricity 16 output by electrical generator 10. The above and other cooperating components convert the energy from the source of power 22 to the electricity 16 that is output by electrical generator 10. As shown in FIGS. 1 through 3, in one embodiment the various components of electrical generator 10 are sized and configured to fit on and be transported by the trailer 18, which typically connects to a motor vehicle, for use as a portable generator.

In a preferred embodiment, the motor 20 is an electric motor and the source of power 22 is one or more batteries or fuel cells 34, which are shown in FIGS. 1 and 3, contained within one or more battery compartments 36 on trailer 18. For purposes of the present disclosure, the term battery or batteries includes a conventional battery or batteries, including lithium ion batteries and the like, and fuel cells and like energy storage devices. In the preferred embodiment, the electric motor 20 is powered by a plurality of batteries 34, such as the four shown in the figures, that are contained in a pair of battery compartments 36, with two batteries 34 being stored in each battery compartment 36 on each side of trailer 18. In one embodiment, each battery 34 is a twelve volt battery. Batteries 34 are electrically connected to a switching or relay apparatus that is controlled by a logic card or other battery controller 38, shown in FIG. 4, and to a first or low (relatively) power DC/AC inverter 40. In a preferred embodiment, the battery controller 38 is configured to selectively control the use and charging of the batteries 34 by allowing the power inverter 40 to draw power from one of the batteries 34 while the other three batteries 34 are being charged, as set forth in more detail below, by the charging alternator 30. As will be readily understood by those skilled in the art, the battery controller 38 rotates operation between the four batteries 34 such that while the power in one battery 34 is being drawn down by the first inverter 40, the other three are being charged in order to maintain a ready supply of power from power source 22. In one embodiment, battery controller 38 is a Pro Logic card configured to provide the desired selective operation of the individual batteries 34. First inverter 40 is sized to provide sufficient amount of power to operate electric motor 20.

The electrical generator 10 and generating system 12 can utilize one or more solar panels, although not shown their use and configuration are well known in the art, to provide additional energy source for the source of power 22 (i.e., batteries 34). The electrical generator 10 and generating system 12 can also include the vanadium flow cell system 41, shown in FIGS. 1 through 3, as an additional source of power 22 that works together with batteries 34 to supply electricity to the electrically powered components of electrical generator 10. In the embodiment shown in the figures, vanadium flow cell battery 41 is positioned on trailer 18 below the other components of electrical generator 10. As known in the art, vanadium flow cell battery 41 is a type of rechargeable battery that uses vanadium based electrolytes in compartments separated by a proton exchange membrane. The electrolytes are pumped through the two compartments from separate tanks to produce electricity. One of the advantages of a vanadium flow cell battery 41 is that it can be recharged by replacing the electrolyte (e.g., if no other power source is available). Other advantages of vanadium flow cell battery 41 include the ability to increase its capacity by using larger storage tanks and the fact it can be left completely discharged for long periods of time with no ill effects. Equivalent flow cell batteries may also be useful for electrical generator 10 of the present invention.

Electric motor 20 is operatively connected to a hydraulic pump 26 that pressurizes fluid from fluid tank 42 and then directs it to use by first hydraulic motor 24, which is hydraulically connected to the hydraulic pump 26. A control box 44 controls the pressure for first hydraulic motor 24. In one embodiment, the fluid used with first hydraulic motor 24 is a conventional hydrocarbon-based hydraulic fluid. In the preferred embodiment of the electrical generator 10 of the present invention, however, the fluid stored in fluid tank 42 and utilized to power first hydraulic motor 24 is an environmentally friendly fluid, such as oils produced from the Jojaba shrub, the MegaFlora Tree® or other plants or produced from a variety of biofuel processes. If desired, electrical generator 10 can include a back-up motor to provide hydraulic power to operate first hydraulic motor 24.

The first hydraulic motor 24 has an output shaft 46, best shown in FIG. 2, that operatively connects to the air pressurized hydraulic system 28 and the output alternator 32 utilizing appropriate connecting mechanisms that are well known in the art. The output alternator 32 is electrically connected, via a battery for storage/transmission purposes, to a second or high power DC/AC inverter 48 that is sized and configured to receive the power generated by output alternator 32 and convert it to the amount of electricity 16 desired for electrical generator 10 of the present invention. The electricity 16 output by second inverter 48 is utilized to operate machinery, tools, equipment or a wide variety of electrically-powered devices. In one embodiment, the output electricity 16 from electrical generator 10 can be directed to a second, similarly configured electrical generator 10 to provide additional electrical power output. The number of possible uses for electricity 16 from electrical generator 10 are effectively unlimited.

As set forth above, the rotating shaft 46 of first output hydraulic motor 24 is also utilized by the air pressurized hydraulic system 28 to operate charging alternator 30, which is used to recharge the batteries 34 not utilized to supply power to the electric motor 20, as controlled by the battery controller 38. In the preferred embodiment of electrical generator 10, the air pressurized hydraulic system 28 generally comprises an air compressor 50, a pressurizing tank 52, a hydraulic power unit 54 and a second hydraulic motor 56, as best shown on FIG. 4. The air pressurized hydraulic system 28 is configured to take in atmospheric air and increase its pressure and flow rate so the pressurized air may be utilized by the second hydraulic motor 56 to operate the charging alternator 30 so it may charge, in the preferred embodiment, the three batteries 34 not being controlled by the battery controller 38 to power the first power inverter 40 to supply electrical power to the electric motor 20. In an alternative embodiment, air compressor 50 can be an air blower or like device.

The air compressor 50 of the air pressurized hydraulic system 28 is operatively connected to the shaft 46 of the first hydraulic motor 24 to compress air. In one embodiment, the compressor 50 draws in atmospheric air, pressurizes it to approximately 30 psi and then directs the pressurized air to the pressurizing tank 52 flowing at approximately 7 to 10 cfm. In the preferred embodiment, the pressurized air is directed to pressurizing tank 52 through a pressure tube 58 having an air amplifying means, such as a venturi valve 60 shown in FIG. 1, that is configured to substantially increase the flow rate of the pressurized air flowing into pressurizing tank 52. In a preferred embodiment, the venturi valve 60 is operatively attached to the pressure tube 58 and configured to draw in additional atmospheric air to increase the flow rate of the pressurized air flowing into the pressurizing tank 52 to approximately 140cfm. As set forth in more detail below, the pressurizing tank 52 receives the pressurized air, at approximately 30 psi and 140 cfm, and then increases the pressure the air such that the air output from the pressurizing tank 52 to the air-driven hydraulic power unit 56 is at approximately 70 psi. The increase in the flow rate of the pressurized air, due to air amplifying means (venturi valve 60), into the pressurizing tank 52 charges the pressurizing tank 52 faster. In a preferred embodiment, the fluid tank 42 includes an air heater coil, shown as 53, or radiator on the inside, as best shown on FIG. 3, to heat the air before it goes into the pressurizing tank 52. Raising the temperature of the air will help increase the pressure inside pressurizing tank 52.

Pressurizing tank 52 outputs a continuous stream of pressurized air to the air-driven hydraulic power unit 54. In one embodiment, the hydraulic power unit 54 coverts the low pressure air (70 psi) to high pressure hydraulic fluid at approximately 400 psi, which is utilized to operate the second hydraulic motor 56. Energy efficient and effective air-driven hydraulic power units 54 are available from the Hydronic Corporation out of Farmington Hills, Mich. The second hydraulic motor 56, which may be of the type commonly available from Haldex, with headquarters in Stockholm, Sweden, is operatively connected to charging alternator 30 to drive the charging alternator 30 so that it may supply, as controlled by battery controller 38, electrical power to the batteries 34 to charge those batteries 34 not being utilized by the first power inverter 40 to provide power to electric motor 20.

Figure 6:
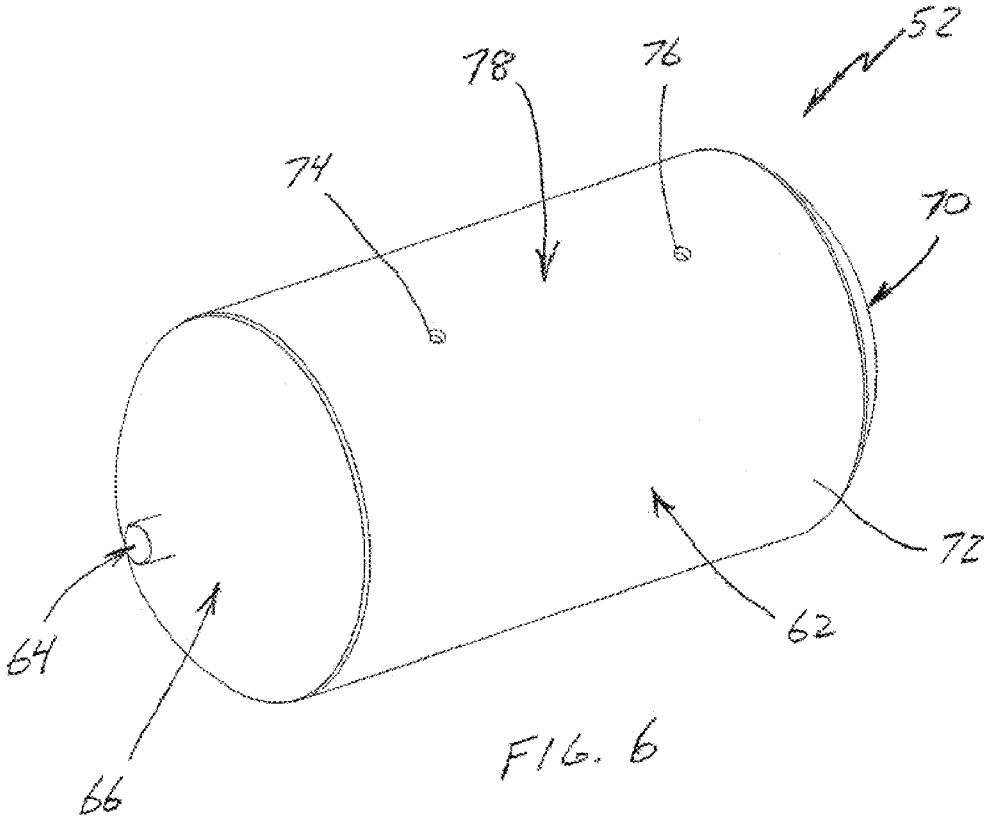
FIG. 6 is a top perspective view of the pressurizing tank utilized with the electrical generator of FIG. 1 showing the inlet at the first end thereof.
Figure 7:
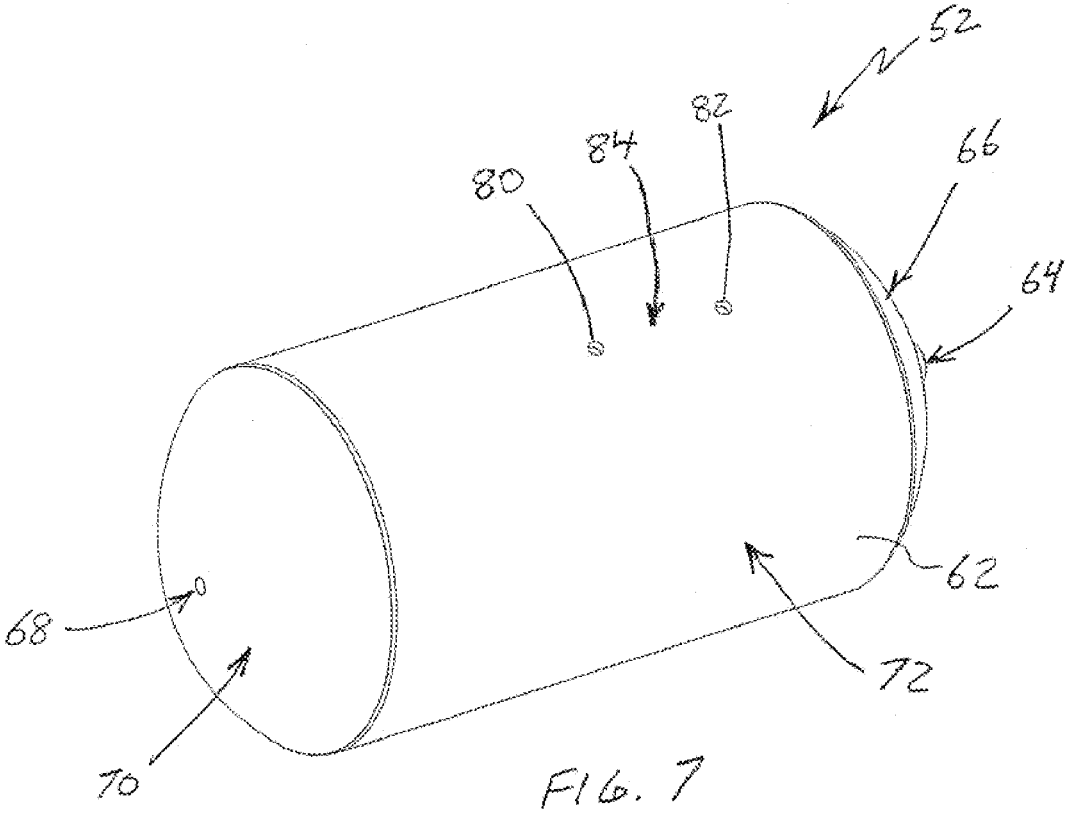
FIG. 7 is a bottom perspective view of the pressurizing tank of FIG. 6 showing the outlet at the second end thereof.

The pressurizing tank 52 of the electrical generator 10 of the present invention is specially configured to provide certain benefits for the operation of the electrical generator 10, namely to increase the pressure of the pressurized air flowing to the hydraulic power unit 54 so it may more effectively and efficiently pressurize the hydraulic fluid for the second hydraulic motor 56. The components of the preferred embodiment of pressurizing tank 52 are shown in FIGS. 6 through 14. As best shown in FIGS. 6 and 7, pressurizing tank 52 comprises an outer cylinder 62 with an air inlet 64 at the first end 66 and an air outlet 68 at the opposite facing second end 70. The pressurizing tank 52 has a tank wall 72 with an upper pressure release aperture 74 and a moisture trap and pressure gauge aperture 76 on the top surface 78 thereof and a lower pressure release aperture 80 and a drain aperture 82 on the bottom surface 84 thereof. Pressure relief valves are operatively disposed in the upper 74 and lower 80 pressure release apertures, such as 80 psi and 90 psi valves (respectively), to release pressure to avoid an explosion. The lower pressure relief valve acts as a back-up to the upper pressure relief valve. A pressure gauge is installed in the pressure gauge aperture 76 and a cockpit valve or the like is installed in the drain aperture 82. In a preferred embodiment, the outer cylinder 62 of pressurizing tank 52 is made out of stainless steel rated to at least 200 psi. In the preferred embodiment, the pressure relief valves are connected to an air purifier, shown as 86 on FIGS. 1 and 2, to clean any air discharged from electrical generator 10.

Figure 8:
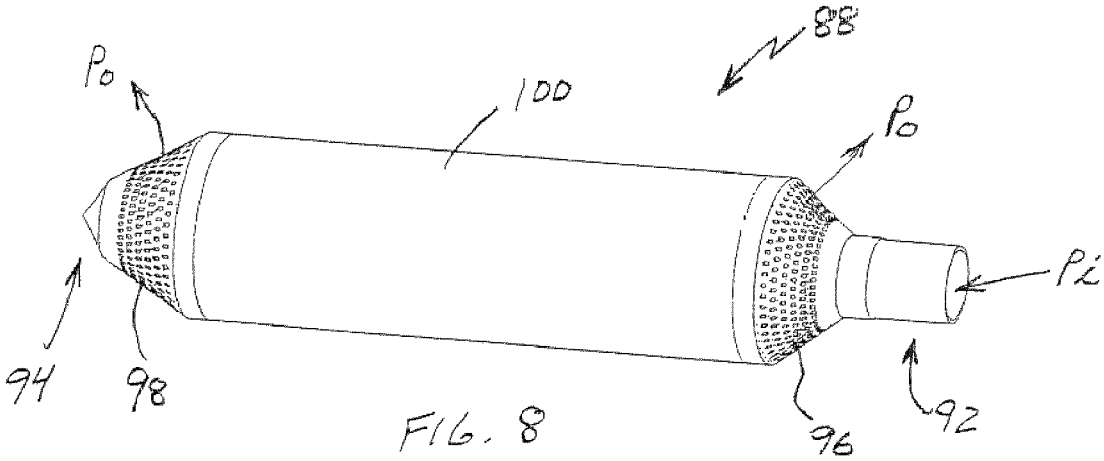
FIG. 8 is a side perspective view of the inner rod assembly of the pressurizing tank of FIGS. 6 and 7 showing the flow of air into the assembly and out the backflow preventers positioned at each end of the assembly.

Disposed inside of outer cylinder 62 is an inner rod assembly 88, which is shown in FIGS. 8 through 14. The inner rod assembly 88 is threadably attached to and in common fluid flow communication with the air inlet 64 to receive pressurized air from the compressor 50, by way of the pressure tube 58 interconnecting the compressor 50 and pressurizing tank 52, into the pressurizing tank 52 so that higher pressure air may be discharged out air outlet 68 to the hydraulic power unit 54. As best shown in FIG. 8, inner rod assembly 88 has an elongated tubular shaped inner rod 90 having an open first end 92 to receive pressurized air, shown as Pi, from compressor 50 through the pressure tube 58 and air inlet 64 of outer cylinder 62, and a closed second end 94 that forces the higher pressurized air, shown as Po into the interior of outer cylinder 62 so that it will exit air outlet 68 to the hydraulic power unit 54. Inner rod assembly 88 is disposed in a cantilever-like position with the first end 92 thereof sealably supported, by being threadably attached, to the first end 66 of the outer cylinder 62 and the second end 94 being in spaced apart relation to the inside surface of tank wall 72 at the second end 70 and sides of outer cylinder 62.

Figure 9:
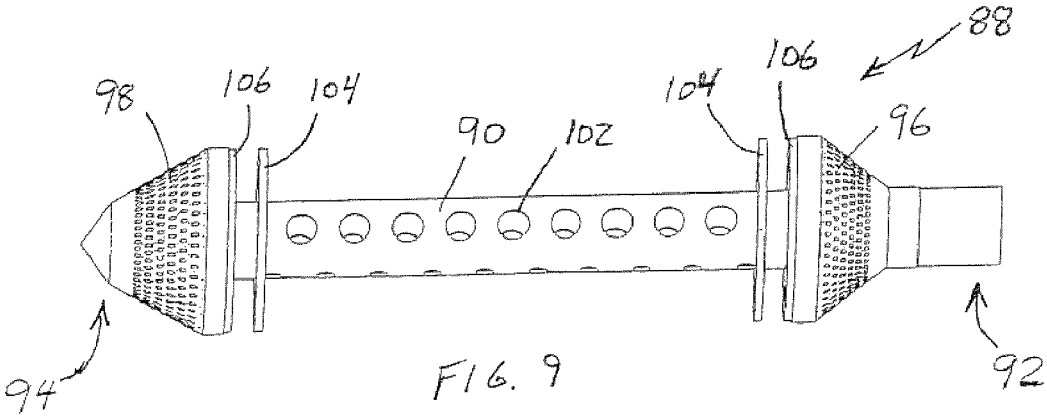
FIG. 9 is a side view of the inner rod assembly of FIG. 8 with the housing removed to show rod apertures.
Figure 10:
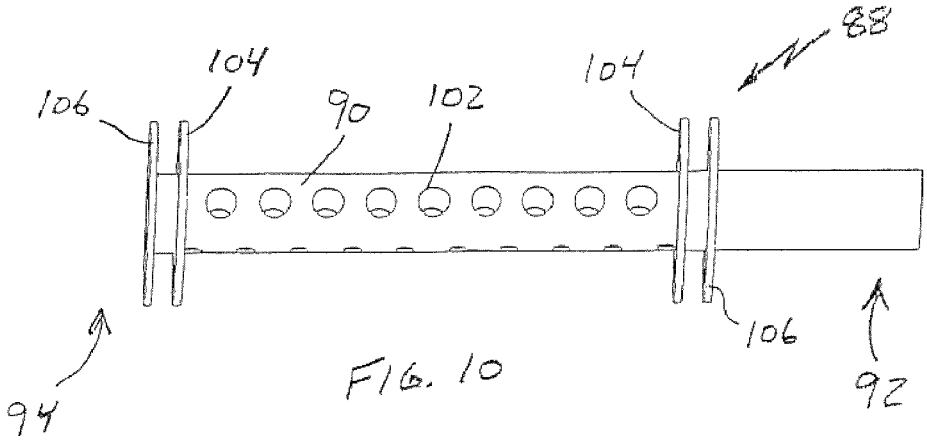
FIG. 10 is a side view of the inner rod assembly of FIG. 9 with the backflow preventers removed to better illustrate the baffles.

Inner rod assembly 88 has a first backflow preventer 96 toward the first end 92 of inner rod 90, a second backflow preventer 98 toward the second end 94 of inner rod 90 and a housing 100 sealably disposed between the first 96 and second 98 backflow preventers. The area of inner rod 90 between backflow preventers 96/98, which is enclosed by housing 100, has a plurality of discharge apertures 102, shown in FIGS. 9 and 10 with the housing 100 removed from the inner rod assembly 88, that allows the pressurized air Pi from the open first end 92 to flow into the housing 100 and then directs the air out backflow preventers 96/98. The size, configuration and exact number of discharge apertures 102 is not believed to be critical to the function of the pressurizing tank 52. As also shown in FIGS. 9 and 10, the inner rod assembly 88 further comprises an inner baffle 104 and an outer baffle 106 towards each of the first end 92 and second end 94 of inner rod 90. Pressurized air Pi exits the discharge apertures 102 into the area enclosed by housing 100 and flows through the inner baffles 104 and the outer baffles 106 at the first backflow preventer 96 and the second backflow preventer 98. The backflow preventers 96/98 are configured to prevent the increased pressurized air Po from flowing back toward the compressor 50, which is at a lower pressure, so the air may exit the air outlet 68 and flow towards the hydraulic power unit 54. The baffles 104/106 are configured to further reduce the likelihood of backflow by lowering the pressure to encourage air to flow through the backflow preventers 96/98.

Figure 11:
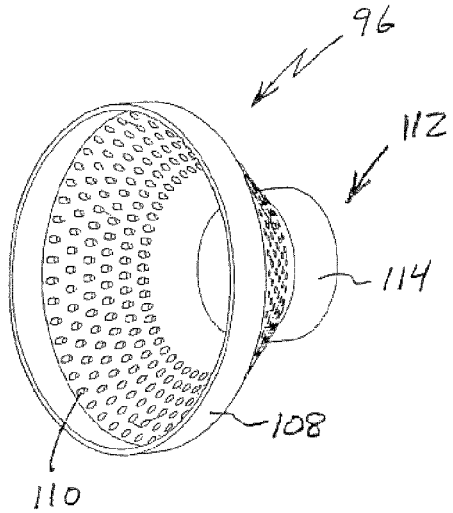
FIG. 11 is an end perspective view of the first backflow preventer utilized at the first end of the inner rod assembly of FIG. 8.
Figure 12:
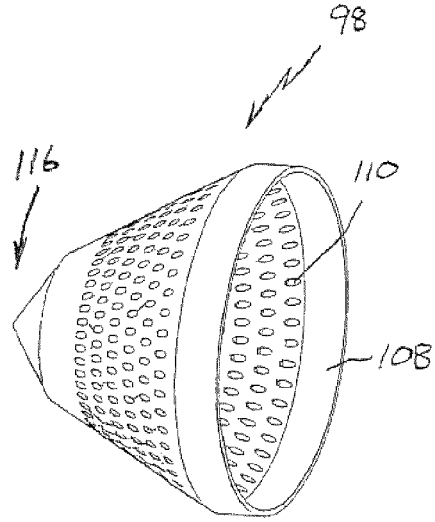
FIG. 12 is an end perspective view of the second backflow preventer utilized at the second end of the inner rod assembly of FIG. 8.

As best shown in FIGS. 11 and 12 with regard to the preferred embodiment of the inner rod assembly 88, the backflow preventers 96/98 each have a conically shaped body, shown as 108, having a plurality of small equally sized apertures 110 through which the higher pressurized air Po flows into the outer cylinder 62 and out the air outlet 68. It is believed that a conically shaped body 108 better prevents undesirable backflow. In one embodiment, each row of apertures 110 has fifty apertures 110, which are forced closer together has the body 108 narrows due to the cone shape. The outward end 112 of first backflow preventer 96 comprises a tubular sleeve 114 that fits tightly (and sealably) over the inner rod 90, as best shown in FIGS. 8 and 9. The outward end 116 of the second backflow preventer 98 is closed to prevent the pressurized air from flowing out the second end 94 of inner rod 90, thereby directing the pressurized air to the interior of the outer cylinder 62 and out the air outlet 68.

Figure 13:
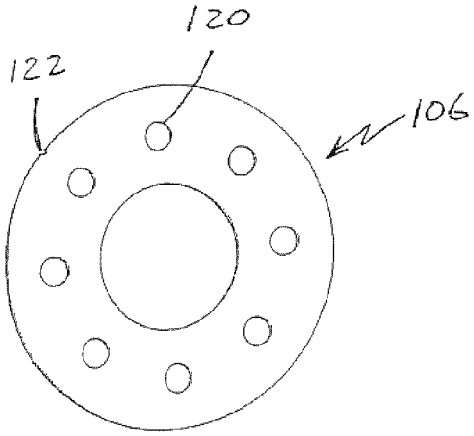
FIG. 13 is an end view of the outer baffle utilized at the first end of the inner rod assembly of FIG. 8.
Figure 14:
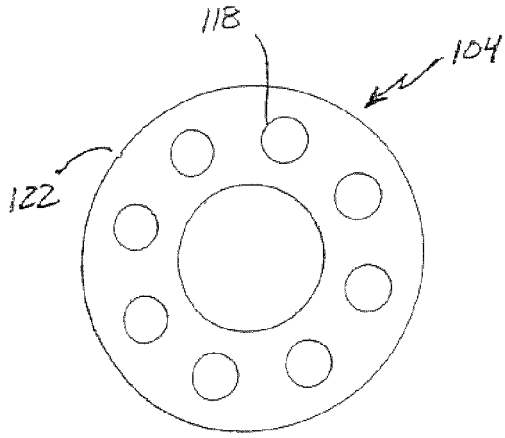
FIG. 14 is an end view of the inner baffle utilized at the first end of the inner rod assembly of FIG. 8.

The baffles 104 and 106 are cooperatively configured to provide the baffling benefits desired for the inner rod assembly 88. As best shown in FIGS. 13 and 14, the inner baffles 104 have a plurality of inner apertures 118 and the outer baffles 106 have a plurality of outer apertures 120. The area of each of the inner apertures 118 of the inner baffles 104 is larger than the area of each of the outer apertures 120 of the outer baffles 106, resulting from the larger diameters for the round inner 118 and outer 120 apertures. In one embodiment, the inner baffles 104 have inner apertures 118 with a diameter of approximately 0.40 inches and the outer baffles 106 have outer apertures 120 with a diameter of 0.25 inches. To provide the desired baffling, inner apertures 118 and outer apertures 120 are offset from each other. Preferably, a keyway 122 is utilized on each of the inner baffles 104 and outer baffles 106 to insure that the proper offsetting is achieved during fabrication of the inner rod assembly 88. In use, baffles 104 and 106 perform similar to a check valve without the restrictions normally associated with a check valve.

Figure 15:
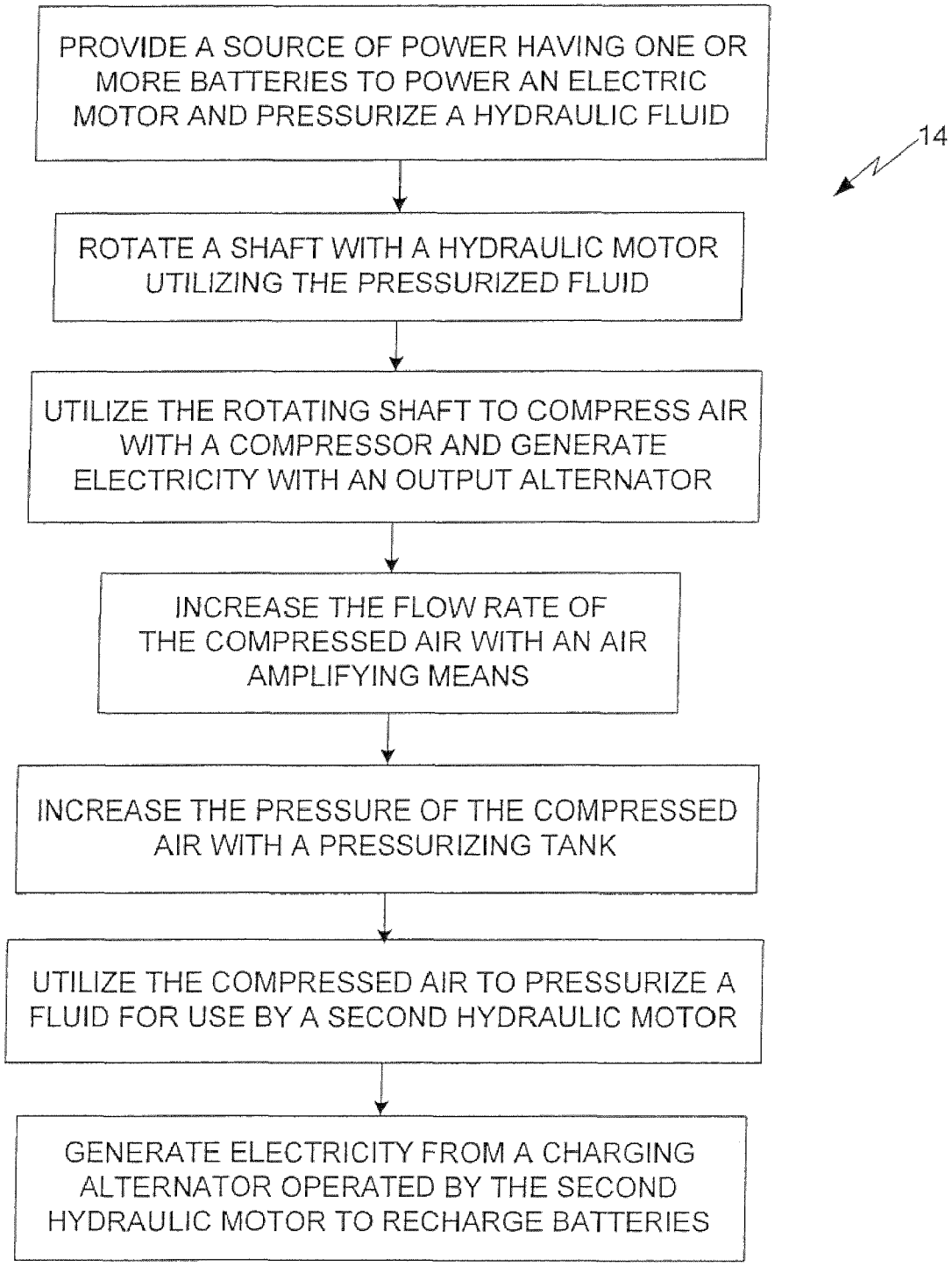
FIG. 15 is a chart summarizing the method of generating electricity according to a preferred embodiment of the present invention.

The method of generating electricity 14 according to a preferred embodiment of the present invention is summarized in FIG. 15. As set forth therein and in the discussion above, the method 14 initially comprises the step of providing a source of power 22 having one or more batteries 34 to power an electric motor 20, by way of first inverter 40, so that the motor 20 may operate a hydraulic pump 26 to pressurize a hydraulic fluid. The pressurized hydraulic fluid is utilized by a hydraulic motor 24 for rotating its shaft 46. The rotating shaft 46 is operatively connected to and utilized by compressor 50 to compress atmospheric air and by an output alternator 32 to generate electricity, which is directed to a second inverter 48 to produce the output electricity 16 desired from electrical generator 10. An air amplifying means, such as a venturi valve 60, increases the flow rate of the pressurized air from the compressor 50, which is directed to a pressurizing tank 52 through a pressure tube 58. The pressurizing tank 52 receives the pressurized air Pi from the pressure tube 58 through the air inlet 64 at the first end 66 of the outer cylinder 62 and into the open first end 92 of the inner rod 90 of inner rod assembly 88. The pressurized air Pi flows into the inner rod 90 and out the discharge apertures 102 enclosed by housing 100 such that higher pressurized air Po is directed through an inner baffle 104, an outer baffle 106 and backflow preventers 96/98 at the first end 92 and the second end 94, respectively with regard to the backflow preventers 96/98, of inner rod 90. The higher pressure pressurized air Po flows out the backflow preventers 96/98, into the interior of the outer cylinder 62 and out the air outlet 68 at the second end 70 of outer cylinder 62. The pressurized air Po output from the pressurizing tank 52 is directed into a hydraulic power unit 54 to pressurize hydraulic fluid for use by the second hydraulic motor 56. The second hydraulic motor 56 is operatively connected to the charging alternator 30 to drive it so that the charging alternator 30 may produce electricity for use in recharging one or more of the batteries 34 in the source of power 22 so the batteries 34 will be ready for use by the electric motor 20, as described above.

In addition to generating electricity 16, one of the advantages of the electrical generator 10 of the present invention is that it produces the electricity 16 in an environmentally friendly manner. In the preferred embodiment, the electrical generator 10 utilizes no hydrocarbon-based fuels, such as gasoline, diesel, propane and the like, and does not utilize any hydrocarbon fluids as the hydraulic fluid. All exhaust discharged by the electrical generator 10 is filtered by a filtering mechanism, such as the air filter 86 shown in the figures. As such, the electrical generator 10 of the present invention has much less of an impact on the environment than currently available electrical generators.

A variety of modifications to the electrical generator 10 are possible. For instance, the flow chart of FIG. 5 shows use of a non-battery source of power 22 that is used to power a motor 20 which is utilized to operate the hydraulic pump 26 that pressurizes the hydraulic fluid utilized by first hydraulic motor 24 to rotate the shaft 46 that operates the compressor 50 and output alternator 32. In one embodiment, the source of power 22 can be solar cell or wind energy system that provides electrical power to an electric motor 20. In another embodiment, the source of power 22 can be a bio-fuel or other environmentally friendly fuel that powers a non-electric motor 20. In either embodiment, or any similarly configured embodiments, the DC electricity produced by the charging alternator 30 can be directed to a battery storage system 124, as shown in FIG. 5, and utilized to charge batteries as an additional or back-up source of DC electricity for the second inverter 48 that is used to produce electricity 16. The generating means to produce the desired electricity could be a belt-driven generator in place of the output alternator 32 and second inverter 48. If desired, an air motor can be utilized instead of the hydraulic power unit 54 and second hydraulic motor 56 to provide power to operate the charging alternator 30. As well known in the art, the various belts and pulleys referenced in the text and shown in the drawings can be replaced with gears and power transmission systems, including hydraulic power systems, to spin the compressor 50. A variety of other modifications can also be made to the various components and the configuration of the components described above.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. An electrical generator, comprising:

a source of power;

a motor powered by said source of power;

a hydraulic pump operatively connected to said motor to pressurize hydraulic fluid for use by a first hydraulic motor to rotate a shaft operatively connected thereto;

an output alternator operatively connected to said shaft to generate output electricity;

a compressor operatively connected to said shaft to pressurize air and direct the pressurized air through a pressure tube;

a pressurizing tank connected to said pressure tube for receiving the pressurized air and increasing the pressure thereof said pressurizing tank comprises an outer cylinder and an inner rod assembly disposed in said outer cylinder, said outer cylinder having an air inlet at a first end and an air outlet at a second end thereof, said inner rod assembly having an inner rod with an open first end at said air inlet and a closed second end towards said second end of said outer cylinder, said inner rod assembly configured to input pressurized air into said outer cylinder and out said air outlet to a hydraulic power unit;

the hydraulic power unit pneumatically connected to said pressurizing tank for receiving pressurized air therefrom and utilizing the pressurized air to pressurize hydraulic fluid for use by a second hydraulic motor; and a charging alternator operatively connected to said second hydraulic motor to generate electricity for recharging one or more of said batteries.

2. The electrical generator of claim 1, wherein said motor is an electric motor and at least one of said one or more batteries is utilized as said source of power for said electric motor.

3. The electrical generator of claim 2, wherein said batteries are operatively connected to a battery controller configured to select said at least one of said one or more batteries for use by said electric motor and the remaining batteries for recharging by said recharging alternator.

4. The electrical generator of claim 1 further comprising a battery storage system having said one or more batteries, said battery storage system configured to increase or back-up said output electricity.

5. The electrical generator of claim 1 further comprising an air amplifying means operatively connected to said pressure tube for increasing the flow rate of the pressurized air into said pressurizing tank.

6. The electrical generator of claim 1, wherein said inner rod of said inner rod assembly has a first backflow preventer towards said first end of said inner rod, a second backflow preventer towards said second end of said inner rod, a plurality of discharge apertures in said inner rod between said first backflow preventer and said second backflow preventer and a housing interconnecting said first backflow preventer and said second backflow preventer and enclosing said discharge apertures to direct pressurized air from said inner rod to outside of said inner rod assembly through said first backflow preventer and said second backflow preventer.

7. The electrical generator of claim 6, wherein said inner rod assembly further comprises an inner baffle and an outer baffle towards each of said first end and said second end of said inner rod, one of said inner baffle and said outer baffle disposed between said discharge apertures and said first backflow preventer and one of said inner baffle and said outer baffle disposed between said discharge apertures and said second backflow preventer.

8. The electrical generator of claim 7, wherein each of said first backflow preventer and said second backflow preventer has a conically shaped body with a plurality of apertures thereon.

9. The electrical generator of claim 7, wherein said each of said inner baffles has a plurality of inner apertures and each of said outer baffles has a plurality of outer apertures, the size of said inner apertures being larger than the size of said outer apertures.

10. The electrical generator of claim 9, wherein said inner apertures on said inner baffles are in offset alignment with said outer apertures on said outer baffles.

11. An electrical generating system, comprising:

a first hydraulic motor operated by hydraulic fluid pressurized by a hydraulic pump operatively connected to an electric motor powered by a source of power having one or more batteries, said hydraulic motor configured to rotate a shaft operatively connected thereto;

an output alternator operatively connected to said shaft to generate output electricity; and an air pressurized hydraulic system operatively connected to said shaft and configured to pressurize air for use to pressurize a fluid and operate a second hydraulic motor operatively connected to a recharging alternator for recharging said one or more batteries, said air pressurized hydraulic system comprising a pressurizing tank for receiving pressurized air and increasing the pressure thereof said pressurizing tank having an outer cylinder and an inner rod assembly disposed in said outer cylinder, said outer cylinder having an air inlet at a first end and an air outlet at a second end thereof, said inner rod assembly having an inner rod with an open first end at said air inlet and a closed second end towards said second end of said outer cylinder, said inner rod assembly configured to input pressurized air into said outer cylinder and out said air outlet to a hydraulic power unit.

12. The electrical generating system of claim 11, wherein said inner rod of said inner rod assembly has a first backflow preventer towards said first end of said inner rod, a second backflow preventer towards said second end of said inner rod, a plurality of discharge apertures in said inner rod between said first backflow preventer and said second backflow preventer and a housing interconnecting said first backflow preventer and said second backflow preventer and enclosing said discharge apertures to direct pressurized air from said inner rod to outside of said inner rod assembly through said first backflow preventer and said second backflow preventer.

13. The electrical generating system of claim 12, wherein said inner rod assembly further comprises an inner baffle and an outer baffle towards each of said first end and said second end of said inner rod, one of said inner baffle and said outer baffle disposed between said discharge apertures and said first backflow preventer and one of said inner baffle and said outer baffle disposed between said discharge apertures and said second backflow preventer.

14. The electrical generating system of claim 11, wherein each of said first backflow preventer and said second backflow preventer has a conically shaped body with a plurality of apertures thereon, each of said inner baffles has a plurality of inner apertures thereon and each of said outer baffles has a plurality of outer apertures, the size of said inner apertures being larger than the size of said outer apertures.

15. The electrical generating system of claim 11, wherein said batteries are operatively connected to a battery controller configured to select said at least one of said one or more batteries for use by said electric motor and the remaining batteries for recharging by said recharging alternator.

16. A method of generating electricity, said method comprising the steps of:

a) providing a source of power having one or more batteries to power an electric motor;

b) pressurizing a hydraulic fluid with a pump operatively connected to said electric motor;

c) rotating a shaft attached to a first hydraulic motor powered by the hydraulic fluid from said pump;

d) pressurizing air with a compressor operatively connected to said first hydraulic motor to generate compressed air and generating electricity with an output generator operatively connected to said shaft;

e) increasing the pressure of the compressed air with a pressurizing tank, said pressurizing tank pneumatically connected to said compressor to receive the compressed air said pressurizing tank having an outer cylinder and an inner rod assembly disposed in said outer cylinder, said outer cylinder having an air inlet at a first end and an air outlet at a second end thereof, said inner rod assembly having an inner rod with an open first end at said air inlet and a closed second end towards said second end of said outer cylinder, said inner rod assembly configured to input pressurized air into said outer cylinder and out said air outlet to a hydraulic power unit;

f) utilizing the compressed air from said pressurizing tank to pressurize a fluid in the hydraulic power unit for use by a second hydraulic motor, said hydraulic power unit pneumatically connected to said pressurizing tank and hydraulically connected to said second hydraulic motor; and g) generating output electricity from a charging alternator operatively connected to said second hydraulic motor, said charging alternator electrically connected to said batteries to recharge said batteries.

17. The method of claim 16 further comprising the step of increasing the flow rate of the compressed air after said air pressurizing step with an air amplifying means connected to a pressure tube interconnecting said compressor and said pressurizing tank.

* * * * *